United States Patent [19]

Stoll et al.

[11] Patent Number: 4,896,584

[45] Date of Patent: Jan. 30, 1990

[54] PISTON-CYLINDER ASSEMBLY

[76] Inventors: Kurt Stoll, Lenzhalde 72; Gerhard Hihn, Schurwaldstr. 7, both of 7300 Esslingen, Fed. Rep. of Germany

[21] Appl. No.: 111,997

[22] Filed: Oct. 21, 1987

[30] Foreign Application Priority Data

Oct. 22, 1986 [DE] Fed. Rep. of Germany ..... 3635893

[51] Int. Cl.[4] ..... F01B 25/26; F01B 31/12

[52] U.S. Cl. ..... 92/5 R; 92/165 PR; 92/177; 91/DIG. 4

[58] Field of Search ..... 92/5, 177, 178, 201, 92/165 PR, 166; 91/DIG. 4

[56] References Cited

U.S. PATENT DOCUMENTS

| | | | |
|---|---|---|---|
| 2,446,657 | 8/1948 | MacLeod et al. | 91/DIG. 4 |
| 2,983,256 | 5/1961 | Seeloff | 92/177 |
| 3,180,236 | 5/1965 | Beckett | 92/166 |
| 4,176,586 | 12/1979 | Stoll et al. | 91/DIG. 4 |
| 4,378,726 | 4/1983 | Stoll | 91/DIG. 4 |
| 4,488,477 | 12/1984 | Miyamoto | 91/DIG. 4 |
| 4,549,469 | 10/1985 | Plester et al. | 92/5 R |
| 4,664,019 | 5/1987 | Lipinski et al. | 92/5 R |
| 4,744,287 | 5/1988 | Miyamoto | 92/165 PR |

FOREIGN PATENT DOCUMENTS

| | | | |
|---|---|---|---|
| 2348066 | 3/1975 | Fed. Rep. of Germany | 92/5 R |
| 2828344 | 1/1980 | Fed. Rep. of Germany | 92/5 R |
| 2245865 | 4/1975 | France | 92/177 |
| 2106984 | 4/1983 | United Kingdom . | |

*Primary Examiner*—Robert E. Garrett
*Assistant Examiner*—Thomas Denion
*Attorney, Agent, or Firm*—Flynn, Thiel, Boutell & Tanis

[57] ABSTRACT

A piston-cylinder assembly wherein in the cylinder housing there is provided a cylinder chamber extending in axial direction, in which cylinder chamber a piston is movably guided in axial direction. Both the piston and also the cylinder chamber have a cross section which is different from a circular shape. A permanent-magnet piece is arranged fixedly in the area of the outer circumference of the piston. A switch arranged in the area of the linear path of movement of the permanent-magnet piece is provided on the outside on the cylinder housing, which switch can be operated without contact by the magnetic field of the permanent-magnet piece.

12 Claims, 3 Drawing Sheets

PISTON-CYLINDER ASSEMBLY

FIELD OF THE INVENTION

The invention relates to a piston-cylinder assembly comprising a cylinder housing having an inner cylinder chamber extending in axial direction, in which cylinder chamber is provided a piston which is movable in axial direction and is guided by a guide surface defined by the interior side wall surface of the cylinder chamber in the region of the outer periphery of which piston there is arranged a permanent magnet which is moved with the movement of the piston, and comprising at least one switch arranged on the outside on the cylinder housing, for example a Reed switch which can be operated when it is encountered by the magnetic field of the permanent magnet, which during the piston movement moves into its immediate region to activate the Reed switch.

BACKGROUND OF THE INVENTION

Such piston-cylinder assemblies are used in order to release, dependent on one or more sliding positions of the piston, further sequences of operation. These can refer to both the piston-cylinder assembly itself, for example to the reversing of the direction of movement of the piston, or to further structural parts or machines. Moreover, this assembly facilitates an interrogation or indication without any problems from individual piston positions. It is thereby of importance for effecting a smooth sequence of operation that the switch, usually arranged n the outer periphery, is operated with precision. To accomplish this precision, it is decisive that the magnetic field of the permanent magnet, during the individual movements of the piston, operates the switch reproducably always in the same piston position. Up to now attempts have been made to solve this problem by constructing the permanent magnet annularly and by arranging same coaxially with respect to the piston which is circular in cross section. The switching operations could thus be released safely even during nonpreventable rotations of the piston about its longitudinal axis. However, the complicated and expensive manufacture of the piston-magnet unit is thereby disadvantageous, because on the one hand the annular magnet is expensive to manufacture and on the other hand regular twopart pistons or diverse fastening parts are needed in order to be able to secure the magnetic ring as best as possible on the piston.

The basic purpose of the invention is therefore to provide a piston-cylinder assembly according to the abovementioned type, which can be manufactured with a high degree of switching precision, with few parts, simply and inexpensively.

SUMMARY OF THE INVENTION

This purpose is attained by the piston having a cross section or outer circumference differing from a circular shape and being nonrotatably movably guided in axial direction with respect to the cylinder chamber in the cylinder chamber, which cylinder chamber has also a cross section differing from the circular shape and is conformingly constructed, by a permanent magnet being a permanent magnet piece fixedly arranged at one point on the outer periphery of the piston and by a switch being arranged on the exterior of the cylinder in the region of the linear path of movement of the permanent-magnet piece.

In this manner a piston-cylinder assembly is provided wherein the piston, based alone on the shape of the piston and the contour of the cylinder chamber conformed to the piston shape, is secured against any rotation about the longitudinal axis of the cylinder chamber. Thus, it is possible to advantageously forego an expensive annular permanent magnet. A relatively small permanent-magnet piece constructed for example as a rod magnet is sufficient to maintain the switching precision. Because the piston is prevented from rotating, the permanent-magnet piece is at the same time also prevented from rotating, so that its position with respect to the switch to be operated remains the same in peripheral direction of the cylinder chamber. The manufacture of the piston and of the cylinder chamber is, in spite of all of this, inexpensive and simple, since both parts can be manufactured substantially as drawn or extruded parts. The magnetic poles are thereby aligned such that both the north pole and also the south pole face in longitudinal direction of the cylinder. A further advantage consists in the piston-cylinder assembly being able to be utilized without a suitable switch even when a prevention of the piston rod from rotating is necessary because of preexisting conditions.

In a further development of the invention, the piston and cylinder chamber have a shape particularly favorable for manufacture, whereby the piston has a substantially cylindrical base structure with elliptical surfaces, which are opposite one another and parallel with one another. These assemblies also have a compact construction, since the outside dimensions of the cylinder housing, in particular in direction of the minor axis of the ellipse, can be kept very small.

In a further development of the invention, the peripheral surface of the piston or parts thereof are used to guide the piston and rest with sliding play or clearance on the guide surface of the cylinder chamber, whereby it is advantageously possible to design the outer contour of the cylinder housing rectangular or square-shaped and thus easy for mounting, but at the same time to arrange the permanent magnet in such a manner in the cylinder chamber that it is provided in a region where the cylinder housing wall thickness is thin, which positively influences the switching strength and the switching precision.

In a further development of the invention, several switches arranged on the outside on the cylinder can be operated in dependency from various piston positions, which broadens the area of use of the piston-cylinder assembly.

In a further development of the invention, it is preferable that a precision working of the outer peripheral surface of the piston is not needed, which reduces the manufacturing costs. The guiding tasks are here taken over by a subsequently mounted guide band. The guide band is particularly preferable in this connection in that it assures a safe sealing of the work chambers separated from one another by the piston in the cylinder chamber.

BRIEF DESCRIPTION OF THE DRAWINGS

The invention will be discussed in greater detail hereinbelow in connection with the enclosed drawings, in which.

DETAILED DESCRIPTION

Figure 1:
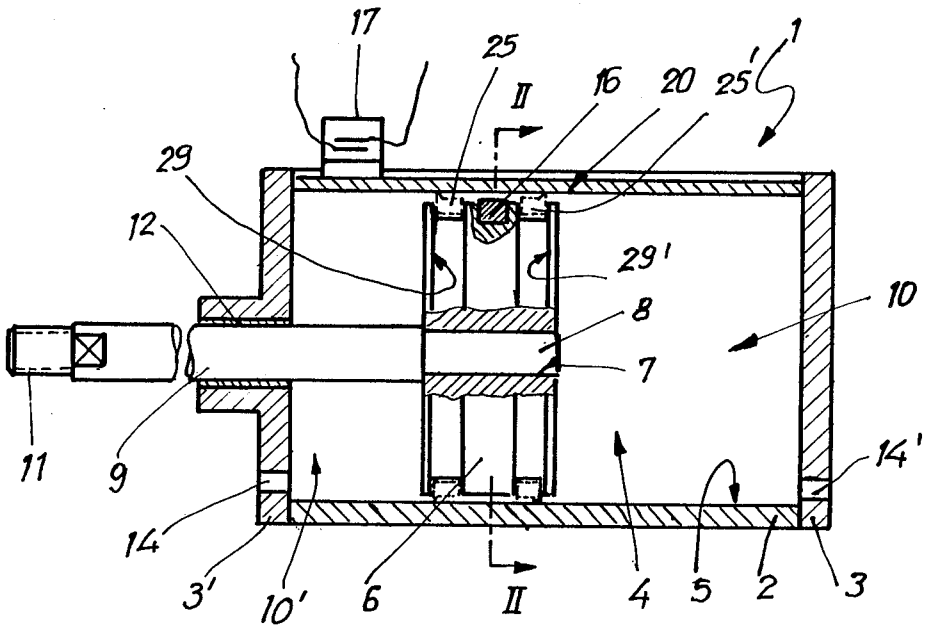
FIG. 1 is a side view of a first design of the inventive piston-cylinder assembly with the cylinder housing broken away and with piston packings, for clarity purposes, being indicated by dashed lines.

The illustrated piston-cylinder assembly 1 in FIGS. 1 to 4 has a substantially rectangularly shaped cylinder housing 2 with cylinder housing end caps 3, 3' arranged at the axial ends of the cylinder housing. A cylinder chamber 4 is provided in the cylinder housing 2, the volume of which chamber is limited or defined by the end caps 3, 3' at the axial ends and by an elliptically shaped, longitudinally extending guide surface 5 constituting an interior side wall of the chamber 4. The guide surface 5 is used to guide a piston 6 arranged in the cylinder chamber and is movable in axial direction. The piston has a central axial opening 7 therethrough into which opening is received a front-end fastening section 8 of a piston rod 9 arranged coaxially to the piston 6 and the cylinder housing 2. The fastening section 8 is received preferably with a press fit in the opening 7 or is adhesively secured therein as is shown in the exemplary embodiment of FIG. 1. The piston rod 9 extends through one of the two work chambers 10, 10' created by the piston 6 in the cylinder chamber 4 and through the associated cylinder housing end cap 3' to the outside, whereby it has a further, externally threaded, fastening section 11 for facilitating a mounting of a structural part to be operated. The hole through the cylinder housing end cap 3' is equipped with a guide and seal arrangement 12 for the piston rod 9.

A connecting opening 14, 14' extend through each of the end caps 3, 3' into both work chambers 10, 10', through which openings it is possible to fill the chambers with pressure medium, for example pressurized air, or to ventilate the chambers in order to, in this manner, move the piston into one or the other direction.

It is possible with the inventive piston-cylinder assembly, in dependence on one or more piston positions in the cylinder chamber, to operate one or more externally arranged switches, which can then control further operating parts not illustrated in the drawing, for example an indicating unit which clearly shows the piston position, valves which influence the further piston movement, or further machines or structural parts of a production unit. In order to implement this, a permanent-magnet piece 16 is arranged fixedly at one point in the region of the outer periphery of the piston 6 and consequently in the region of its peripheral surface 15 facing the guide surface 5. Same is moved in axial direction with the movement of the piston 6. Moreover, there is provided a switch 17 arranged on the exterior surface of the cylinder housing 2. This switch is a Reed switch, in the exemplary embodiments, which can be operated when it is encountered by the magnetic field of the permanent-magnet piece 16 during a piston movement into its area. The switch 17 is actually operated when the per- manent-magnet piece 16 has come so close that the power or strength of its magnetic field is sufficient to close the two contacts of the switch. To assure a precise switching operation, it is thereby of an advantage to arrange the switch 17 as close as possible to the region of the linear path of movement of the permanent-magnet piece 16; therefore, in the arrangement of the exemplary embodiments, the respective permanent-magnet piece 16 and the switch 17 lie on a common imaginary radial line 18 when switching occurs.

Figure 2:
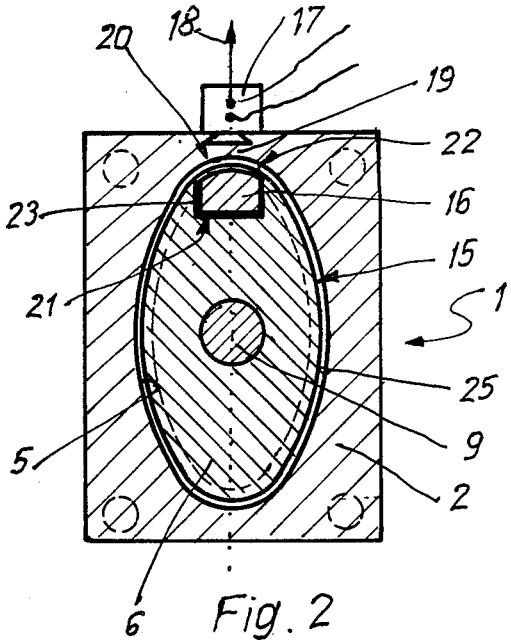
FIG. 2 is a cross-sectional view of the pistoncylinder assembly of FIG. 1 taken along the crosssectional line II—II of FIG. 1.
Figure 4:
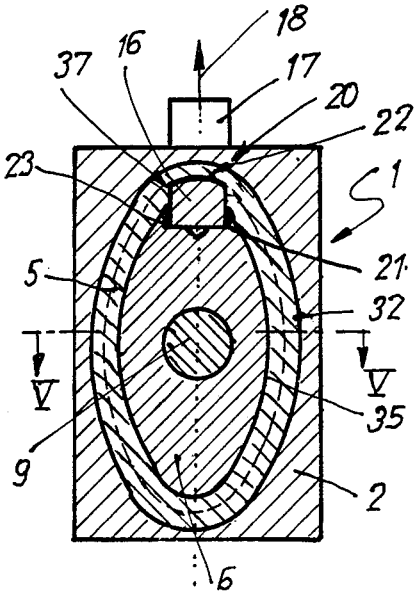
FIG. 4 is a cross-sectional view of a further embodiment of the piston-cylinder assembly analogous to the embodiment of FIG. 2.
Figure 6:
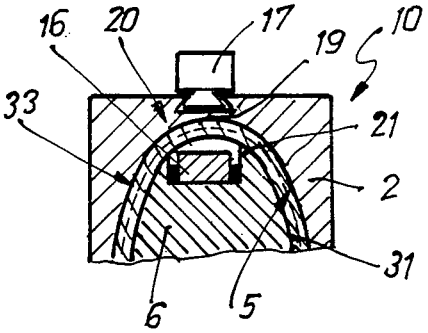
FIG. 6 is a cross-sectional view of a section of a further exemplary embodiment of the piston-cylinder assembly.

In order to prevent the point in time of switching from changing, which could happen for example if the piston 6 rotates during operation and thus the position of the path of movement of the magnet changes, the piston is in all exemplary embodiments prevented from rotating due to the cross-sectional shape of the piston and the piston chamber. More specifically, the structure which prevents the piston from rotating includes the form of the piston 6 and the cylinder chamber 4 itself in that, on the one hand, the piston 6 does not have a circular cross section or outer periphery, but a cross section or outer periphery which differs from the circular shape. The same is true for the cylinder chamber 4, the guide surface 5 of which, viewed in the cross section according to FIGS. 2, 4 and 6, is conformed with respect to its contour to the shape of the piston circumference, but for a certain sliding play or clearance.

In the shown exemplary embodiments, both the piston 6 and also the cylinder chamber 4 have an oval cross-sectional shape or both the outer peripheral contour of the piston 6 and also of the cylinder chamber 4 are elliptical, viewed in axial direction. Thus, one can imagine the cylinder chamber 4 as a mathematical cylinder, which has elliptical surfaces and the outer surface of which is formed by the guide surface 5. The similar situation exists for the piston 6, which has substantially also the basic shape of a mathematical cylinder with elliptical surfaces, whereby the outer surface is formed by the outer peripheral surface of the piston, which outer peripheral surface opposes the guide surface 5.

The particular advantage of this construction lies in both the piston 6 and also the cylinder housing 2 being able to be manufactured as drawn or extruded parts or drawn-profile parts, which thereafter require only little machining input. Nonmagnetic or nonmagnetizable light-metal metal alloys, for example aluminum alloys, can be used particularly as materials. The manufacturing expenses thus are practically not any higher than the ones for piston-cylinder assemblies of the common design.

The oval design has the advantage that, as a whole, compact outer dimensions are obtained. The outer contour of the piston-cylinder assembly 1 or of the cylinder housing 2 is preferably, viewed in cross section, rectangular, whereby two of the longitudinal sides of the rectangle are parallel with the major axis of the ellipse and the other sides with the minor axis of the ellipse. Thus, a narrow, space-saving design is obtained in the direction of the minor axis.

It is advantageous in this connection, as this is also the case in the exemplary embodiments, to arrange the permanent-magnet piece, which in piston-peripheral direction extends only over a fraction of the piston periphery, in an apex region 20 of the outer periphery 15 of the piston 6, which outer periphery faces the guide surface 5. The path of movement of the permanent-magnet piece 16 is thus provided in a region 19 defining the thinnest cylinder wall thickness region, which makes it possible, due to the small distance from the switch 17, to achieve a high degree of switching precision already with small permanent magnets 16 having a small magnetic-field strength.

The permanent-magnet pieces 16 are provided in the exemplary embodiments in the region of a main apex of the elliptical piston 6 and are hereby embedded in a radial recess 21 in the outer periphery 15 of the piston, which outer periphery faces the guide surface 5 such that they do not readily project beyond the peripheral surface of the piston. In the exemplary embodiments according to FIGS. 1 to 4, the contour of the side of the magnet 22 facing the guide surface 5 is conformed to the cylinder chamber surface and is slightly arched in peripheral direction, whereby it almost extends flush with the piston surface. Whereas the permanent-magnet piece in the embodiment according to FIG. 6 is constructed substantially block or cubelike and is reduced with respect to its volume so substantially that it sits deeper inside of the recess 21. An adhesive securement of the magnet in position is possible in every case as a fastening possibility; reference numeral 23 indicates a blackened area representing a suitable adhesive. The permanent-magnet piece 16 is., viewed in axial direction, provided in each case preferably in the region of a longitudinally central plane 18 of the piston.

Figure 3:
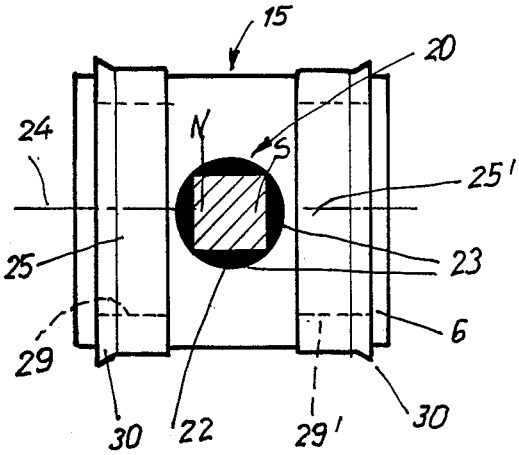
FIG. 3 is a top view of the piston of FIG. 2 in direction of the permanent-magnet piece.

The best possible results regarding the exactness or precision in switching are achieved when the two magnet poles are aligned in axial direction 24, as this is indicated in FIG. 3. A bar magnet is especially adaptable as the permanent-magnet piece.

It is also possible for several permanent-magnet pieces to be distributed over the piston circumference and in particular in the area of several ellipse apexes, whereby accordingly several external switches 17 are provided. This broadens the variation possibilities regarding the operation of further operating units connected to the switches.

The pistons 6 have in the area of their outer circumference 15 two coaxially arranged sealing rings 25, 25' or 26, 26' (not shown in the exemplary embodiment according to FIG. 6). FIG. 1 illustrates the sealing rings 25, 25' in dashed lines for clarity purposes, so that the type of mounting or securement can be better recognized (compare also FIG. 5). As can be seen, two self-contained, axially spaced, annular mounting recesses 29, 29' are provided on the peripheral surface 15 of the piston, which surface 15 opposes the guide surface 5. Each sealing ring exchangeably fits into a respective one of the mounting recesses, which sealing ring consists preferably of a material having rubber-elastic or elastomeric characteristics.

The peripheral surface 15 of the piston cooperates directly, the exemplary embodiment according to FIGS. 1 to 3, with the guide surface 5 for guiding of the piston, and the sealing rings project only slightly in radial direction beyond the peripheral surface 15 with an annular seal portion 30 or packing washer. The seal portions 30 are in the installed state squeezed in radial direction inwardly, so that the surface 15 slides practically on the guide surface 5. Thus, certain precision-working operations on the outer peripheral surface 15 are here necessary.

Figure 5:
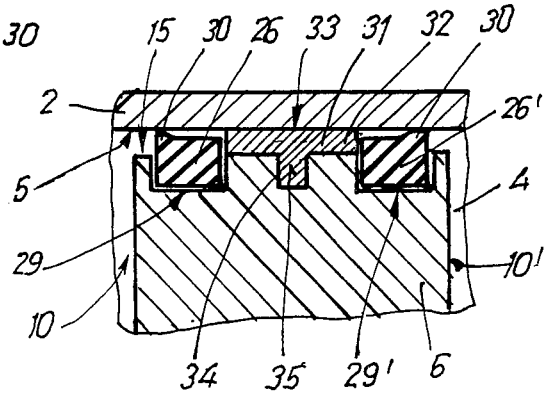
FIG. 5 is a cross-sectional view of an enlarged section of the piston-cylinder assembly of FIG. 4 taken along the cross-sectional line V—V of FIG. 4.

In contrast to this, the peripheral surface 15 of the piston does not have to fulfill any guiding tasks in the exemplary embodiment according to FIGS. 4 and 5. The piston 6 is here surrounded by at least one annular, coaxially arranged piston-guiding band 31 in the area of the peripheral surface 15. The band is fastened to the piston 6 and can be moved with the piston and extends over a section of the piston length. It is provided between the two sealing rings 26, 26' which, just like the sealing rings 25, 25' in the exemplary embodiment according to FIGS. 1 and 3, are arranged on both axial sides of the permanent-magnet piece 16. The band 31 has a sleeve-shaped guide section 31 which rests with its inner side on the piston 6 and the radially outwardly facing guiding surface 33 of which rests with sliding play or clearance on the guide surface 5 of the cylinder 2. An annular rib 35 is formed on the radially inner side of the guide section 32, so that the band 31 has in cross section an approximately T-shaped design. The rib 35 is held in a complementary, annular fastening recess 34 that extends around the piston.

Thus, the piston 6 is guided in the cylinder by the band-guiding surface 33 of the piston-guiding band 31, so that a precision working of the outer surface of the piston, for example a honing or the like, is not needed. This has the advantage that the manufacturing time is substantially reduced.

The piston-guiding band 31 consists in the area of its band-guiding surface 33 preferably of a wear-resistant material and may, moreover, consist of a plastic material, so that on the one hand a simple installation of the band 31 is possible and on the other hand, because of the flexibility of the band 31, canting and thus damages to the wall of the cylinder chamber are impossible.

The seal portion 30 of the sealing ring 26, 26' projects in this exemplary embodiment in radial direction more out of the mounting recess 29, 29' in order to balance out the difference between the cross-sectional shape of the surfaces of the cylinder chamber 4 and the piston 6 and in order to also seal off the two work chambers 10, 10' securely from one another, just like in the other exemplary embodiments.

The piston-guiding band 31 is provided in the same central plane 18 of the piston 6 as is the permanent-magnet piece 16. The permanent-magnet piece 16 is covered by the band 31, but without causing its magnetic field to be weakened. The guiding band 31 and in particular its rib 35 are therefore, at the location of the magnet, provided with a suitable recess 37.

Also in the exemplary embodiment according to FIG. 6, there is utilized a piston-guiding band 31 of the discussed type, however, same is here provided with a continuous cross-sectional form. A recess is not needed here, since the magnetic piece 16 is smaller and is arranged countersunk in the recess 21.

Regarding the manufacture of the cylinder housing 2, it must be added that holes can already be made in the housing during its manufacture by drawing. The holes are used at the front or axially facing end of the cylinder housing to receive screws for effecting a fastening of the cylinder housing end caps. Screws can then be used which are selftapping during a screwing into the mentioned holes, so that again manufacturing time and manufacturing expenses can be saved.

It must be added that the switches 17 are arranged advantageously movably in axial direction on the cylinder housing, for example as shown by means of a guiding device having a dovetail guide. The point in time for switching can thus be varied as desired.

Figure 7:
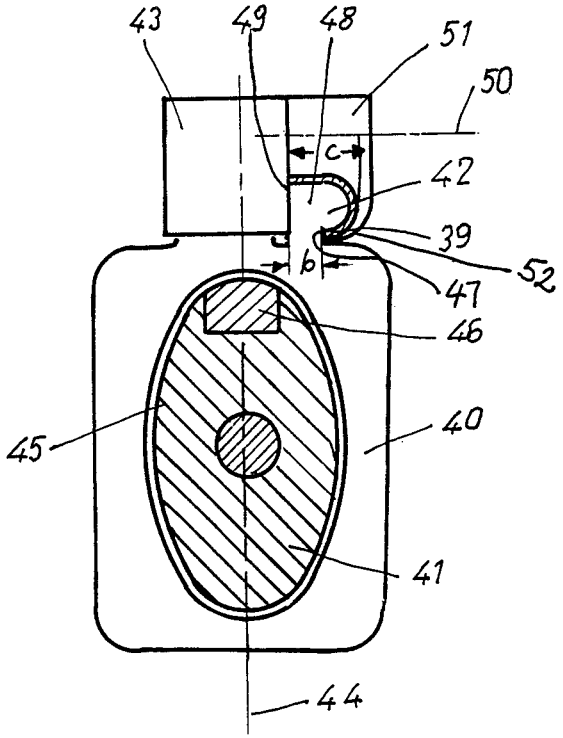
FIG. 7 is a cross-sectional view of a further embodiment of the piston-cylinder assembly according to the invention analogous to the embodiment of FIG. 2.

FIG. 7 illustrates a further modification of the subject matter of the invention, in which the cylinder housing 40, in which the ellipse-shaped piston 41 is guided movably, has a fastening rail 42 or fastening bar on its outer periphery extending in its longitudinal direction and in a paraxial arrangement with respect to it. The length of the rail 42 or bar corresponds practically with the entire length of stroke of the cylinder. The rail 42 or bar is provided for holding the switch 43, which can be constructed for example as a Reed switch. This fastening rail or bar is formed on the cylinder through drawing. It is constructed in one piece with the cylinder. The fastening rail or bar 42 is provided on a side of the cylinder housing which intersects the longitudinally central plane containing the major axis 44 of the elliptically cross-sectioned shape of the piston 45. Further, the rail or bar 42 is laterally offset with respect to the major axis that in a respective end position of the piston — for example a switch may be associated with each end position — the switch 43 is exactly opposite to the rod or pin-shaped magnet 46. The switch 43 and the magnet 46 are hereby in the longitudinally central plane 44 of the cylinder housing 40, which also contains the major axis of the elliptically cross-sectioned shape of the cylinder and the piston.

A generally P-shaped fastening rail or bar 42 is connected to the cylinder housing 40 by a thin web or stem part 47, the width "b" of which is less than the width "C" of the bulbous portion 48 defining the actual mounting part of the fastening rail or bar 42. The bulbous portion faces laterally of the cylinder housing 40. The switch 43 is adjustably and securably movably guided in longitudinal direction on the fastening rail or bar 42. It rests on the one longitudinal side 49 of the fastening rail or bar opposite the bulbous portion and is held on same with the help of a counter-piece 51 which is releasably connected to it, for example by screws (the schematically illustrated screw 50). The counter-piece 51 grips around the bulbous portion 48 of the fastening rail or bar from the aforesaid one side with a preferably clawlike bent shoulder 52, which grips preferably under the laterally outwardly facing part of the bulbous portion 48.

By longitudinally moving the switch 43 along the fastening rail or bar, the points or areas, for example the reversal point, important for the function of the cylinder, can be adjusted as desired, depending on need. However, it is also possible to provide several switches at suitable points along the rail.

The embodiments of the invention in which an exclusive property or privilege is claimed are defined as follows:

1. A piston-cylinder assembly, comprising: 'an elongated cylinder housing made of nonmagnetic material and including means defining an inner cylinder chamber extending in an axial direction thereof, said inner cylinder chamber having noncircular cross section while an external surface thereof is of a nonconforming shape in cross section so as to define at least one region on said cylinder housing wherein a wall thickness dimension is thinner than at other locations, said region being located on a radial axis of said cylinder housing;

a piston made of nonmagnetic material and conformed in shape to and non-rotatably received in said inner cylinder chamber, said piston being movable in axial direction in said inner cylinder chamber and guided by a noncircular guide surface formed by a side wall of said inner cylinder chamber;

means defining a recess in an outer peripheral surface of said piston, said recess being located generally on an axis radially aligned with said radial axis of said cylinder housing;

at least one magnet received in said recess;

said inner cylindrical chamber and said piston being both oval in cross-sectional shape, said recess in said piston being located on a major axis of said oval, and said region whereat said wall thickness is thinnest being located on said major axis of said oval;

at least one switch mounted on an exterior surface on said cylinder housing and arranged within range of the magnetic field of said magnet when said cylinder housing and said switch are generally radially aligned, said switch being operable when present in a magnetic field, whereby said switch is operated by said magnetic field of said magnet when said piston and said switch are generally radially aligned, said noncircular and conforming cross-sectional shapes of said inner cylinder chamber and said piston thereby defining a means for preventing said piston and said cylinder housing moving angularly with respect to each other to maintain a fixed radial alignment relation of said magnet and said switch.

2. The piston-cylinder assembly according to claim 1, wherein said piston and at least said means defining said inner cylinder chamber are constructed as drawn profile parts.

3. The piston-cylinder assembly according to claim 1, wherein said at least one magnet is a rod magnet having magnet poles aligned in said axial direction, is located in the axial central region of said piston, and is glued in particular into said recess in said piston.

4. The piston-cylinder assembly according to claim 1, wherein plural magnets are distributed over the periphery of said piston and are arranged in particular in the region of the several axes of said oval, and wherein plural switches are arranged on said exterior surface of said cylinder housing.

5. The piston-cylinder assembly according to claim 1, wherein said elongated cylinder housing has means defining an axially extending track thereon located on said major axis of said oval; and wherein said at least one switch includes mounting means for facilitating an adjustable sliding movement of said switch in said track means.

6. The piston-cylinder assembly according to claim 1, wherein the piston is surrounded coaxially by at least one annular piston-guiding band which is secured on said piston and is movable with said piston and extends over a section of the piston length, such that the outer periphery of the piston is without contact opposite the guide surface of the cylinder chamber, wherein said guiding band covers the magnet and engages with sliding play or clearance with its radially outwardly facing guiding surface on the guide surface of the cylinder chamber.

7. The piston-cylinder assembly according to claim 1, wherein the cross-sectional surface of the cylinder chamber is larger than the one of the piston, whereby in the area of its outer periphery there is arranged at least one sealing ring which completely surrounds the piston and has a seal portion projecting in radial direction, which sealing ring rests with its entire circumference slidingly and sealingly on the guide surface of the cylinder chamber.

8. The piston-cylinder assembly according to claim 7, wherein at least two annular, selfcontained mounting recesses or grooves are arranged at an axial distance from one an other in the peripheral surface of said piston, each sealing ring being embedded and exchangeably received into said recesses or grooves, while a guiding band is mounted in a fastening recess provided in the outer surface of the piston, which outer surface faces the guide surface coaxially surrounding said piston and arranged in the area of the longitudinal center of the piston.

9. The piston-cylinder assembly according to claim 1, wherein on the outer periphery of the cylinder housings there is provided a fastening rail or bar which extends in longitudinal direction of the cylinder housing in a paraxial arrangement with respect to said cylinder housing and practically over the entire length of stroke, for holding said switch or the switches, said rail or bar being formed on the cylinder housing by drawing or extrusion, whereby it can lie for example outside of the longitudinal center plane containing the major axis of the elliptically cross-sectioned shape of the cylinder chamber.

10. The piston-cylinder assembly according to claim 9, wherein the fastening rail or bar is connected to the cylinder housing through said thin part of said wall, the width of which is less than the width of the enlarged laterally facing portion of the actual mounting part of the fastening rail or bar.

11. The piston-cylinder assembly according to claim 9, wherein the switch rests on a longitudinal side of the fastening rail or bar and is held on it with the help of a counter-piece, which is releasably connected to it and which grips around the fastening rail or bar from the other side with a clawlike bent shoulder which grips under the enlarged part thereof.

12. The piston-cylinder assembly according to claim 9, wherein the fastening rail or bar is offset laterally with respect to the major axis of the ellipse of the cross section that in a suitable end position of the piston, the switch is exactly opposite the magnet whereby the switch and the magnet are located in the longitudinal center plane of the cylinder housing, which also contains the major axis of the ellipse of the cylinder housing or piston cross section.

* * * * *